US010865550B1

(12) United States Patent
Sampson

(10) Patent No.: US 10,865,550 B1
(45) Date of Patent: Dec. 15, 2020

(54) OUTLET BOX WITH INTEGRATED FUNNEL

(71) Applicant: LSP Products Group, Inc., Irving, TX (US)

(72) Inventor: Benjamin Keith Sampson, Reno, NV (US)

(73) Assignee: LSP Products Group, Inc., Irving, TX (US)

( * ) Notice: Subject to any disclaimer, the term of this patent is extended or adjusted under 35 U.S.C. 154(b) by 39 days.

(21) Appl. No.: 16/273,874

(22) Filed: Feb. 12, 2019

Related U.S. Application Data

(60) Provisional application No. 62/629,375, filed on Feb. 12, 2018.

(51) Int. Cl.

| | |
|---|---|
| ***E03C 1/02*** | (2006.01) |
| ***D06F 39/08*** | (2006.01) |
| ***E03C 1/184*** | (2006.01) |
| ***E03B 7/09*** | (2006.01) |

(52) U.S. Cl.
CPC ..... *E03C 1/021* (2013.01); *D06F 39/08* (2013.01); *E03B 7/095* (2013.01); *E03C 1/023* (2013.01); *E03C 1/184* (2013.01); *Y10T 137/698* (2015.04)

(58) Field of Classification Search
CPC ..... Y10T 137/698; E03B 7/095; E03C 1/021
See application file for complete search history.

(56) References Cited

U.S. PATENT DOCUMENTS

| | | | | |
|---|---|---|---|---|
| 3,847,175 | A * | 11/1974 | Anderson | E03C 1/00 137/360 |
| 4,069,837 | A * | 1/1978 | Jirasek | D06F 39/081 137/360 |
| 4,158,471 | A * | 6/1979 | Logsdon | D06F 39/083 137/360 |
| 4,410,004 | A * | 10/1983 | Kifer | D06F 39/08 137/360 |
| 6,148,850 | A * | 11/2000 | Kopp | D06F 39/08 137/356 |
| 8,020,581 | B1 * | 9/2011 | Julian | D06F 39/085 137/360 |
| 9,534,363 | B2 * | 1/2017 | Williams | E03C 1/284 |
| 10,385,554 | B2 * | 8/2019 | O'Neill | E03C 1/021 |

* cited by examiner

*Primary Examiner* — Kevin F Murphy
(74) *Attorney, Agent, or Firm* — Thomas Horstemeyer, LLP

(57) ABSTRACT

Disclosed are various embodiments of a multi-purpose outlet box with an integrated drainage funnel. In one embodiment, the outlet box can include a housing that includes a top wall, a bottom wall, a back wall, a first side wall, a second side wall, and an opening providing access to the housing. The outlet box can include a funnel that forms a portion of the back wall and that extends from the bottom wall. The funnel can also include a first end and a second end. The first end comprises a first opening outside of the housing and the second end comprising a removable cover that covers access to a second opening inside of the housing. The top wall includes a drainage opening and the second end of the funnel is proximal to the drainage opening.

19 Claims, 7 Drawing Sheets

OUTLET BOX WITH INTEGRATED FUNNEL

REFERENCE TO RELATED CASES

This application claims priority to and the benefit of U.S. Provisional Patent Application No. 62/629,375 filed on Feb. 12, 2018 and entitled "Outlet Box with Integrated Funnel," which is incorporated herein by reference in its entirety.

BACKGROUND

Oftentimes, one or more outlet boxes are used for housing water supply valves and a drainage opening for a washer machine. An outlet box can include an enclosure that is mounted between sheets of drywall. The water supply valves can control the hot and cold water supply lines for the washer machine. The drainage opening is connected to a drainage pipe. The drainage opening can be used for draining water from a washer machine through a drainage hose inserted into the drainage opening.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

Figure 1A:
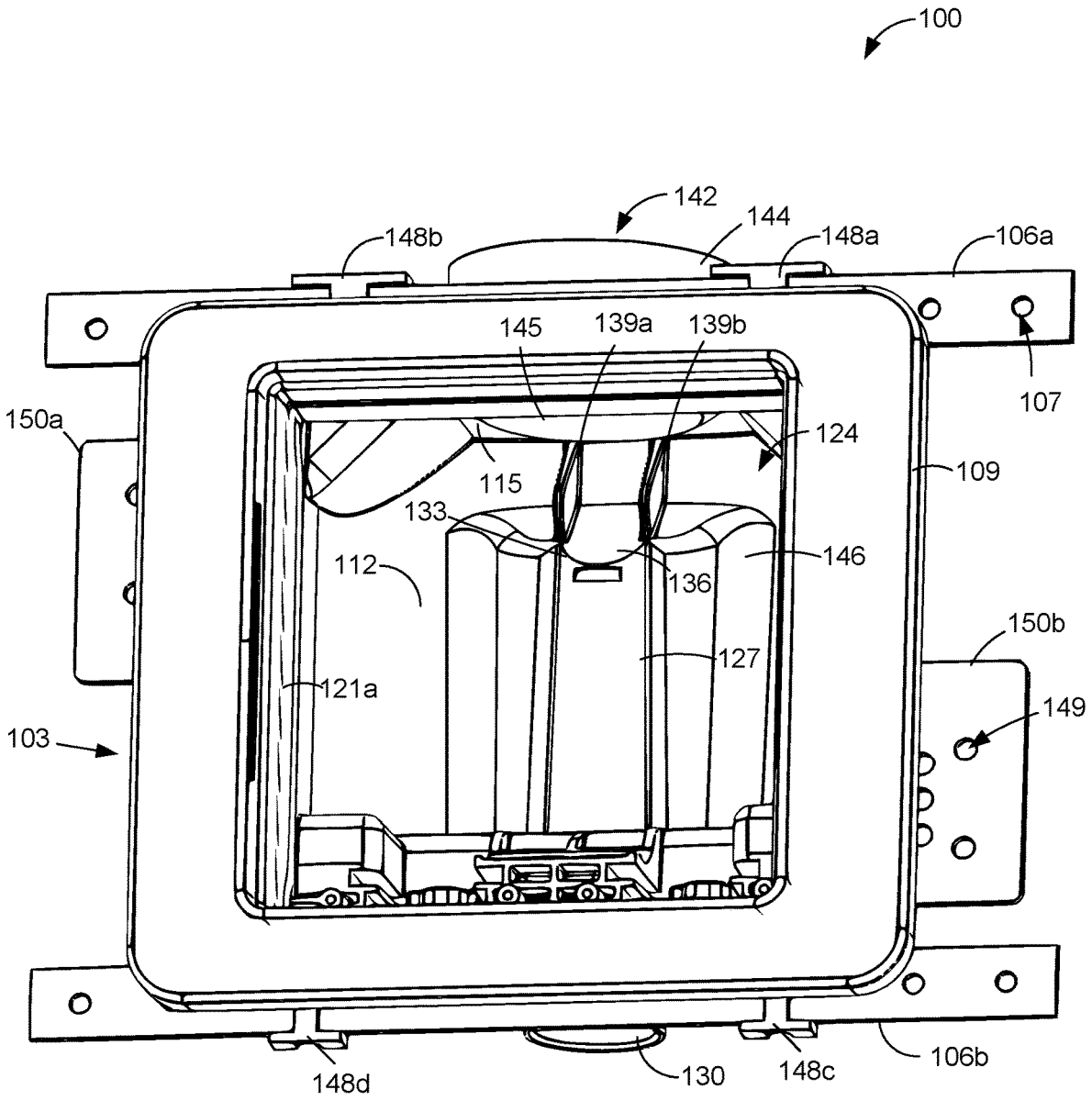
FIG. 1A is a front perspective view of an outlet box, according to one embodiment described herein.

In residential and commercial construction, an outlet box can be mounted within an opening cut through drywall and attached to one or two wall studs. In some scenarios, outlet boxes can be used for connecting a washer machine with the water supply lines and the drainage pipe behind the drywall. Oftentimes, an outlet box can be used to house the water supply valves and a drainage opening that is connected to the drainage pipe. One end of a drainage hose from the washer machine can be inserted into the drainage opening. By way of the drainage hose, water flows out of the washer machine through the drainage opening and into the drainage pipe. However, other appliance systems may need drainage access to the drainage pipe.

The embodiments of the present disclosure relate to an improved outlet box with an integrated funnel that provides drainage access to multiple appliance systems. As a non-limiting example, the embodiments of the outlet box can house water supply valve connections for a washer machine and provide a drainage opening for a drainage hose of the washer machine. Additionally, the integrated funnel can be connected to another system, such as a HVAC system, and provide access to the drainage opening and the drainage pipe for other purposes. Thus, instead of manually constructing a separate pipe system that leads directly to the drainage opening in the outlet box, the embodiments of the outlet box include an integrated funnel. The embodiments solve certain issues related to manually constructing a separate pipe system for channeling drainage into the outlet box, such as pipe seals leaking over time, pipe alignment during installation, and the extra time allocated to installing the pipe system.

Additionally, as one skilled in the art can appreciate, the embodiments can be used to drain water from other appliances, such as water softeners, ice makers, refrigerators, dishwashers, and other residential and commercial appliances. For example, a water softener may need to be drained or cycled periodically. The drainage channel of the water softener can be attached to the funnel of the outlet box as described herein. The embodiments can also be used in other scenarios to house two or three valves, such as for BBQ grills, stoves, gas boxes, and other residential and commercial appliances.

Further, the embodiments can be used in different configurations. For instance, in a first configuration, the water supply valve inlets for the outlet box can be positioned on the bottom, and the drainage opening can be positioned on the top. In this configuration, the outlet box can be used to route the water supply lines from beneath the outlet box. In a second configuration, the outlet box can be rotated 180 degrees from the first configuration. In the second configuration, the outlet box can be used for housing the connections to a washer machine and an HVAC system as previously described. Alternatively, the second configuration can be used to merely connect a drainage channel of another system to a drainage pipe. Thus, contractors can use the same outlet box for various different situations and connections. Turning to the drawings, a general description of embodiments of an outlet box and its components is provided, followed by a discussion of the operation of the same.

Figure 1B:
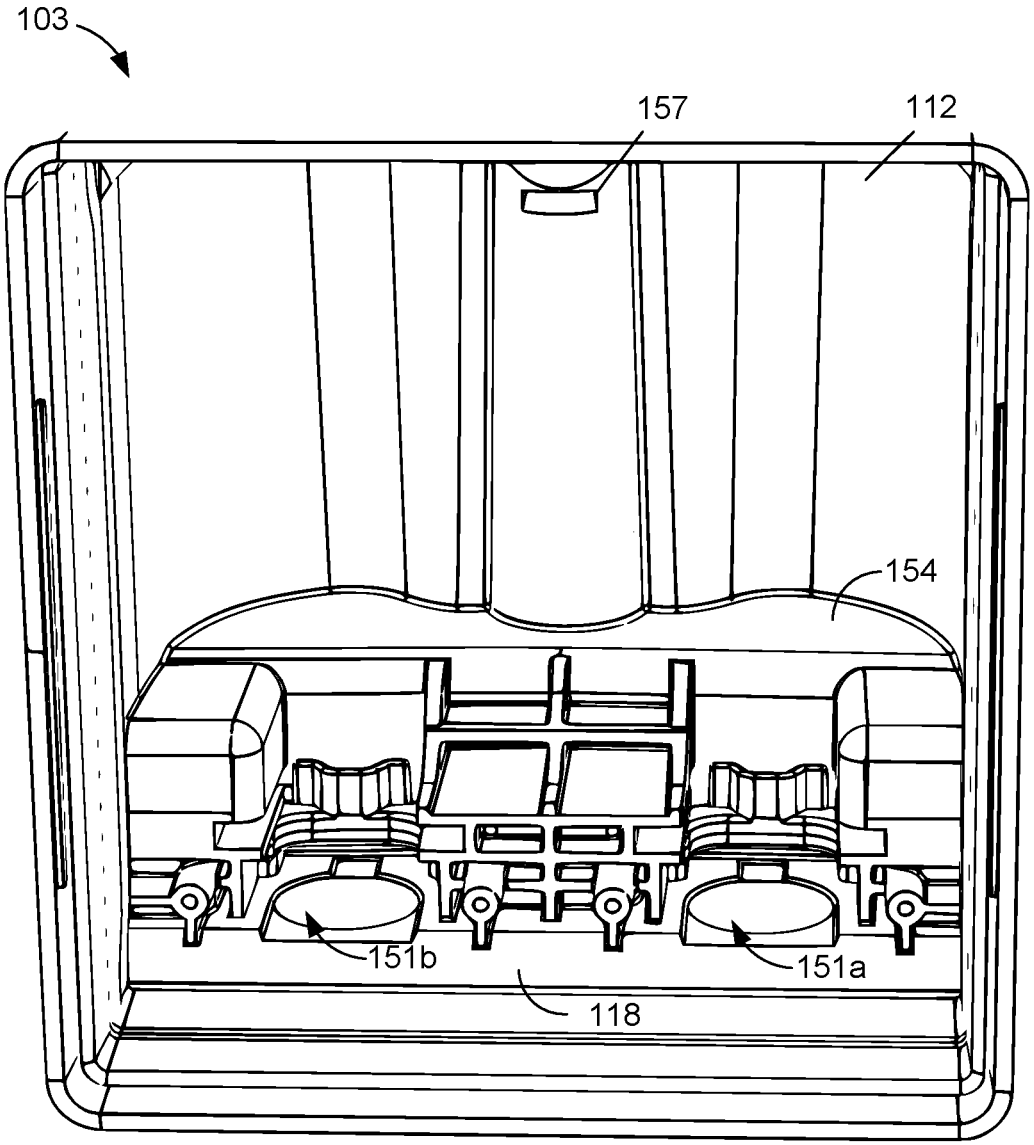
FIG. 1B illustrates an enlarged view of the outlet box in FIG. 1A at a different angle, according to one embodiment described herein.

FIG. 1A shows a perspective view of an outlet box assembly 100, and FIG. 1B illustrates an enlarged view of the outlet box from another angle. Referring between FIGS. 1A and 1B, the outlet box assembly 100 can comprise an outlet box 103, a first mounting bracket 106*a*, and a second mounting bracket 106*b*. The outlet box 103 can comprise a frame 109, a first wall 112, a second wall 115, a third wall 118, a first side wall 121*a*, and a second side wall 121*b* (collectively "side walls 121"). For the purposes of this disclosure, the first wall 112 will also be referred to as the back wall 112, the second wall 115 will also be referred as the top wall 115, and the third wall 118 also will be referred to as the bottom wall 118. The outlet box 103 can comprise a housing enclosure that has an opening 124 that provides access to an interior of the enclosure. In the illustrated embodiment, the frame 109 forms a perimeter around the opening 124. The mounting brackets 106 can be secured to two or more wall studs for mounting the outlet box 103. The mounting brackets 106 comprise multiple apertures 107.

In addition, the outlet box 103 comprises a funnel 127 that forms a portion of the back wall 112. The funnel 127 channels water drainage or other suitable liquids from an application system to another location, such as a drainage pipe. The funnel 127 can be an elongated cylinder that comprises a first end 130 and a second end 133. The first end 130 comprises an outside opening that is accessible outside of the outlet box 103. The second end 133 has an interior opening that is accessible from the interior of the outlet box 103. Thus, the funnel 127 can extend from outside of the outlet box 103 to inside the outlet box 103. Within the interior of the outlet box, the funnel 127 can comprise a curved outer surface that curves toward the frame 109 and that forms a portion of the back wall 112. At the second end 133, the funnel 127 comprises a first removable cover 136 that covers the interior opening of the funnel 127. The first removable cover 136 can be useful when the funnel 127 is not being used because it prevents having an opening in the outlet box 103 that leads to the interior of a wall.

In addition, the outlet box 103 comprises a first fin 139*a* and a second fin 139*b* (collectively "fins 139"). The fins 139 can be used to guide water drainage coming out from the second end 133 of the funnel 127. The fins 139 can also be used as a stop for a drainage hose from a washer machine, for example. The fins 139 can prevent the flow of water from the second end 133 from splashing on the drainage hose and ultimately filling the interior of the outlet box 103 with water. The fins 139 can be attached to the second end of the funnel 127 and extend to the back wall 112.

The top wall 115 of the outlet box 103 comprises a drainage opening 142 that is covered by a second removable cover 145. The second removable cover 145 can be useful when the drainage opening 142 is not in use. It prevents having an opening into the interior of the wall when not in use. On the outside of the outlet box 103, the top wall 115 comprises a drainage cylinder 144 that aligns with the drainage opening 142. The drainage cylinder 144 can be attached to a drainage pipe in a residential or commercial structure. When the second removable cover 145 is removed, the drainage opening 142 provides a channel for water drainage to flow from the interior of the outlet box 103 through the drainage cylinder 144 and to the drainage pipe. The back wall 112 also comprises an inclined surface 146 on each side of the funnel 127. In FIG. 1A, the inclined surface 146 rises from a lower portion of the back wall 112 to an elevated portion of the funnel 127. The inclined surface 146 can be useful during the removal of the outlet box 103 from a mold during manufacturing.

Additionally, the top wall 115 comprises a first mount 148*a* and a second mount 148*b*, and the bottom wall 118 comprises a third mount 148*c* and a fourth mount 148*d* (collectively "the mounts 148). The mounts 148 comprise a slot aperture that is used for inserting the mounting brackets 106. The outlet box 103 can also include a first mounting tab 150*a* and a second mounting tab 150*b* (collectively "mounting tabs 150") that extend from one of the side walls 121. The mounting tabs 150 comprise multiple apertures 149. The mounting tabs 150 can be positioned along a wall stud and secured to the wall stud by inserting fasteners through the apertures 149.

Turning to FIG. 1B, shown is an enlarged view of the interior of the outlet box 103 in FIG. 1A at a different angle. As illustrated in FIG. 1B, the bottom wall 118 comprises a first valve aperture 151*a* and a second valve aperture 151*b* (collectively "valve apertures 151"). The water supply valves can be inserted through the valve apertures 151. As a non-limiting example, the water supply valves can be connected to a hot and a cold water supply line to control the flow of each water supply line to a washer machine.

FIG. 1B and FIG. 1A also illustrate that the bottom wall 118 comprises an elevated platform 154. In the illustrated embodiment, the funnel 127 extends from the elevated platform 154 and along the back wall 112. In addition, the funnel 127 comprises a recessed area 157 proximate to the second end 133 and recessed from the outer surface of the funnel 127. The recessed area 157 can be used to facilitate removing the first removable cover 136. As a non-limiting example, a pointed end of a screwdriver, a chisel, or other suitable instrument can be inserted in the recessed area 157. Force can be applied to the instrument to puncture and pry the first removable cover 136 off of the second end 133 of the funnel 127.

Figure 1C:
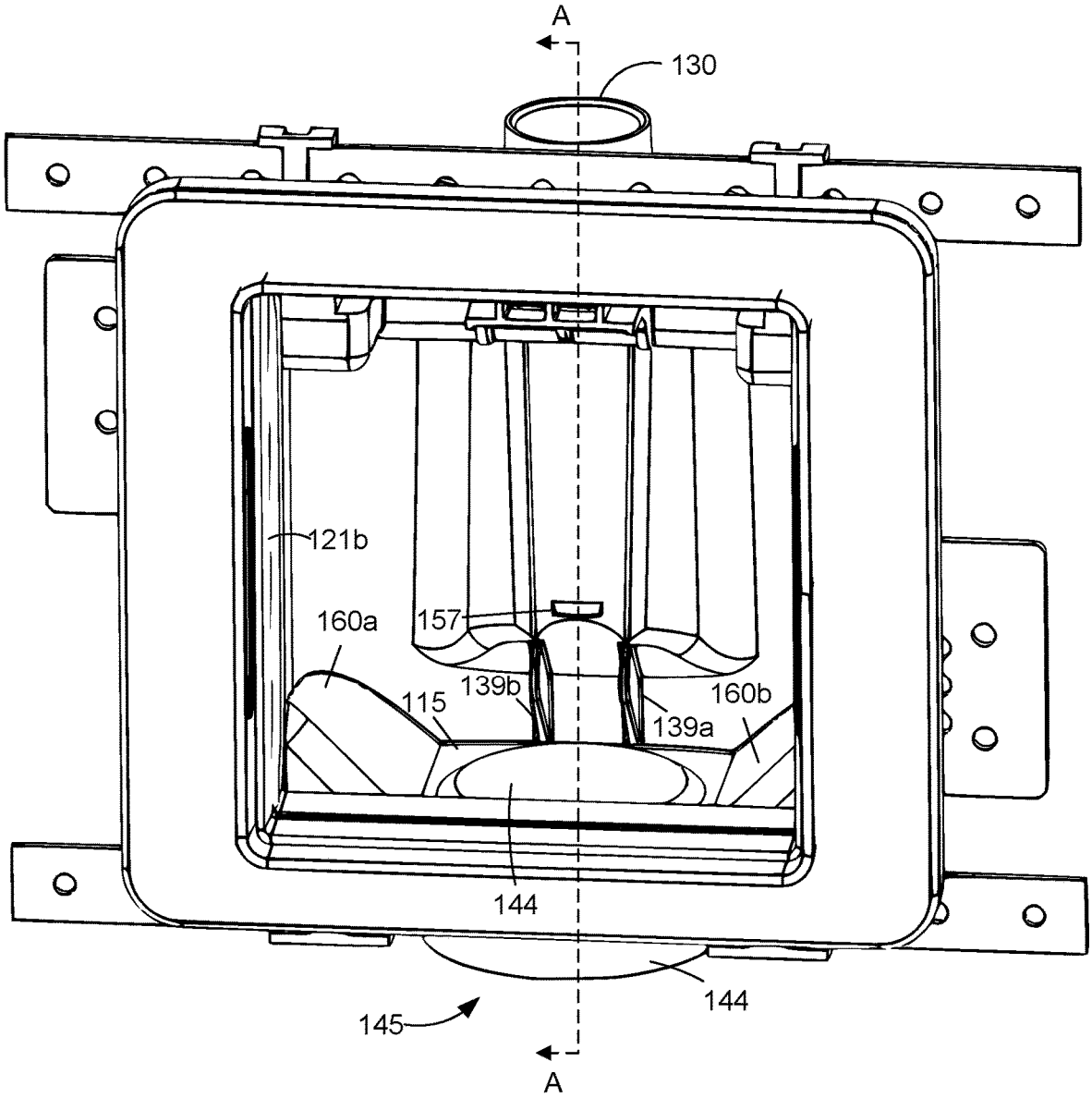
FIG. 1C is an inverted perspective of the outlet box in FIG. 1A, according to one embodiment described herein.
Figure 2:
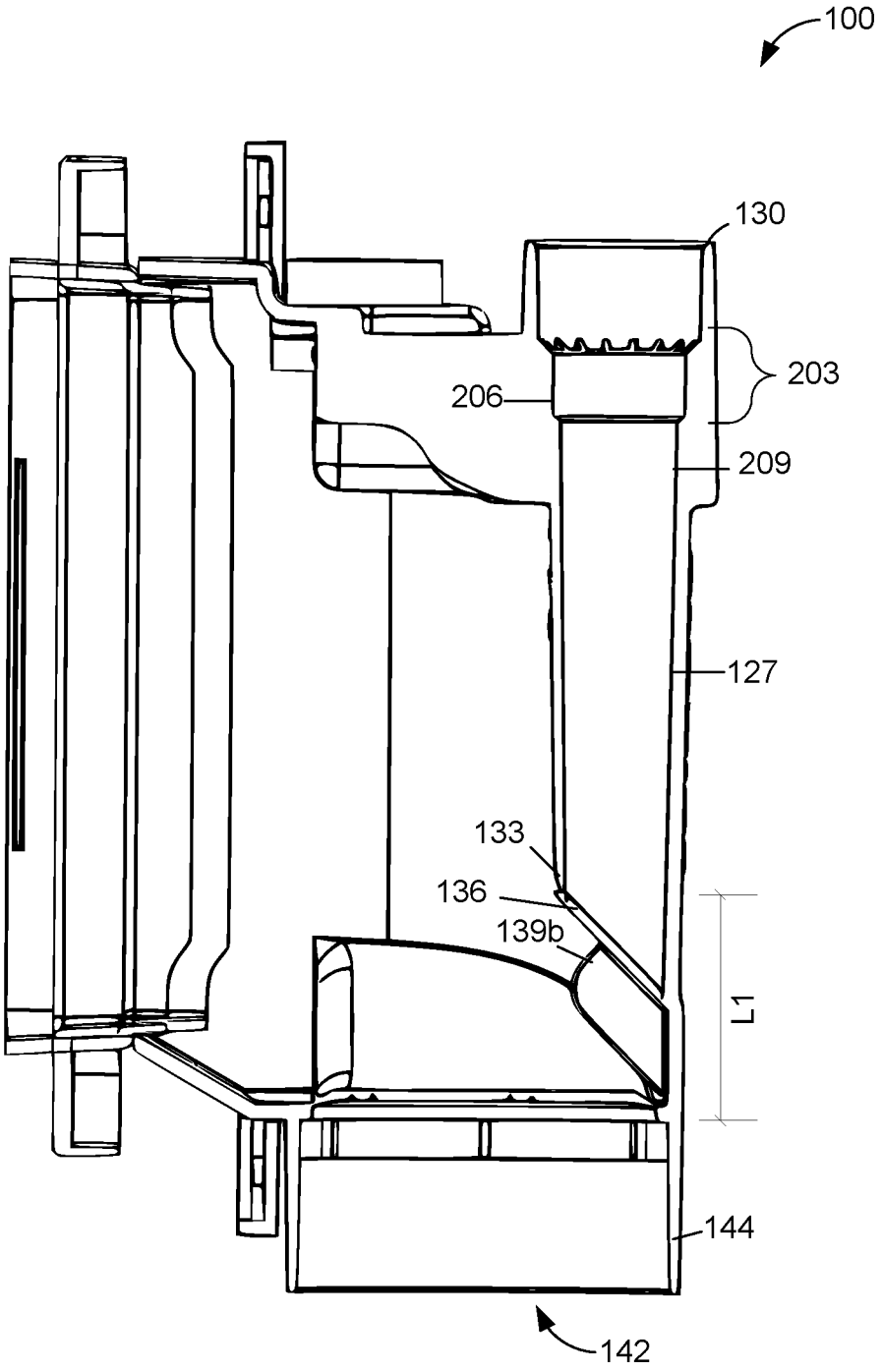
FIG. 2 is a cross sectional view of the outlet box in FIG. 1C, according to one embodiment described herein.

Turning to FIG. 1C, shown is an inverted perspective view of the outlet box 103 in FIG. 1A and FIG. 1B. FIGS. 1A and 1B illustrate the outlet box 103 in a first configuration and FIG. 1C illustrates the outlet box 103 in a second configuration that is rotated 180 degrees from the first configuration. Additionally, FIG. 1C designates a cross sectional view "A-A" which is shown in FIG. 2. FIG. 1C illustrates that the top wall 115 (or the second wall 115) comprises a first sloped surface 160*a* and a second sloped surface 160*b* (collectively "sloped surfaces 160"). The sloped surfaces 160 extend from the top wall 115 to one of the side walls 121.

Referring among FIGS. 1A-1C, a description of the operation of the outlet box 103 is provided. In the first configuration (FIGS. 1A and 1B), as a non-limiting example, the outlet box 103 can be secured to wall studs by aligning the mounting tabs 150 against the surface of wall studs. Then, a fastener can be inserted through the apertures 149 and into the wall studs.

Alternatively, the mounting brackets 106 can be inserted into the mounts 148 of one or more outlet boxes 103. The mounting brackets 106 can be positioned along two or more wall studs. Fasteners can be inserted through the apertures 107 of the mounting brackets 106 and into the wall studs. In other words, in this embodiment, the outlet box 103 is not directly secured to the wall stud. Instead, the mounting brackets 106 are secured to two or more wall studs. The one or more outlet box 103 can then be moved laterally along the mounting bracket 106 to the desired location. In some embodiments, fasteners can be inserted into the apertures 107 to prevent the outlet box 103 from moving.

Next, in the first configuration, the water valves can be inserted through the valves apertures 151. For example, a hot water valve and a cold water valve can be positioned in the interior of the outlet box 103 and extend through the valve apertures 151 to connect to the water supply lines for a residential or commercial structure. The water valves can control the flow of the hot and cold water to a washing machine. Drywall can be positioned behind and around the frame 109.

In the second configuration (FIG. 1C), the water valves can be inserted through the valve apertures 151 as in the first configuration. However, in the second configuration, the water valves would be inverted. The first end 130 of the funnel 127 can be connected to a drainage channel of an appliance system, such as a HVAC system. The drainage cylinder 144 can be attached to a drainage pipe within the residential or commercial structure. The second removable cover 145 can be removed by angling a screwdriver on the surface and puncturing through the second removable cover 145 with the screwdriver. Then, the second removable cover 145 can be pried off by rotating the screwdriver.

The first removable cover 136 can also be removed by positioning the screwdriver in the recessed area 157. The screwdriver can be angled in the recessed area 157 and used to puncture through the material above the first removable cover 136. The screwdriver can be pivoted to pry the first removable cover 136 off of the outlet box 103. Then, water drainage from the HVAC system can flow into the first end 130 of the funnel 127 and into the drainage opening 142, which leads to a drainage pipe.

In addition, the outlet box 103 can be used in combination with a second outlet box 103. As a non-limiting example, the outlet box 103 can be positioned in the second configuration, and the second outlet box can be positioned in the first configuration. By having the outlet box 103 in the second configuration and the second outlet box in the first configuration, the second mounting tab 150*b* of the outlet box 103 can be aligned below the first mounting tab 150*a* of the second outlet box 103. The mounting tabs 150 can be secured to the same wall stud. Alternatively, the mounting brackets 106 of the outlet box 103 can be secured to two wall studs by inserting fasteners through the apertures 107 and into the wall studs. The outlet box 103 and the second outlet box 103 can share the same set of mounting brackets 106. As a result, the outlet box 103 and the second outlet box 103 can be moved laterally along the mounting brackets 106 to a desired position.

Turning to FIG. 2, shown is a cross sectional view of the outlet box 103 in FIG. 1C. FIG. 2 illustrates that the fin 139*b* extends away from the back wall 112 and is angled. In some embodiments, the fins 139 are angled substantially similar to the angle of the first removable cover 136 with respect to the back wall 112. In other words, a bottom edge of the fins 139 can be substantially parallel to the first removable cover 136 with respect to the back wall 112. The fins 139 can also be used as a stop to prevent the drainage hose from a washer machine or other appliance system from being positioned too close to the back wall 112 and underneath the second end 133 of the funnel 127. By preventing the drainage hose from being too close, the fins 139 can prevent a drainage hose from inhibiting the flow of drainage into the drainage opening 142 from the funnel 127. Particularly, without the fins 139 serving as a stop, the water drainage coming out of the second end 133 of the funnel could splash onto the drainage hose and around the interior of the outlet box 103.

Next, FIG. 2 illustrates that at the first end 130 of the funnel 127 comprises a glue trap 203 within the interior of the funnel 127. The glue trap 203 can be used to capture excess liquid adhesive that is used to bond a pipe to the outlet box 103. If the excess liquid adhesive is not captured, it may flow down to the first removable cover 136 and accumulate. As it accumulates, the adhesive can solidify around the first removable cover 136 and as a result, the accumulated adhesive can make the removal of the first removable cover 136 more difficult. Thus, the glue trap 203 can prevent the excess liquid adhesive from accumulating around the first removable cover 136. In the illustrated embodiment, the glue trap 203 comprises an inner ring 206 and is connected to an inner tube 209 adjacent to the glue trap 203

In FIG. 2, the outlet box 103 is positioned in the second configuration. As discussed previously, the first end 130 of the funnel 127 can be connected to a drainage channel of an appliance system, such an HVAC system. For example, the HVAC system can use a polyvinyl chloride (PVC) or Acrylonitrile Butadiene Styrene (ABS) pipe for its drainage channel. Liquid adhesive can be applied to the outer surface of an end of the PVC or ABS pipe and then inserted into the first end 130 of the funnel 127. In some embodiments, the PVC or ABS pipe can be inserted such that the end of the PVC pipe is positioned above the glue trap 203. Excess liquid adhesive can drain into the glue trap 203 and prevent the excess liquid adhesive from moving further into the funnel 127. In some embodiments, the PVC or ABS pipe can have a smaller diameter than the inner ring 206 but larger than a diameter of the inner tube 209. For example, the first end 130 of the funnel 127 can be configured to support a PVC or ABS pipe of half an inch inside of the glue trap 203 and a three-fourths of an inch PVC or ABS pipe just above the glue trap 203. For instance, if the HVAC system has a half-inch PVC or ABS pipe, an end of the PVC pipe can be positioned above the inner tube 209 and within the inner ring 206. In another scenario, if the HVAC system has a three-fourths of an inch PVC or ABS pipe, the PVC or ABS pipe can be positioned within the first end 130 of the funnel and above the glue trap 203. In other words, the PVC pipe can be placed on top of the glue trap 203 or within the glue trap 203 according to the diameter of the PVC or ABS pipe.

As a non-limiting example of the operational of the outlet box 103, water drainage from an appliance system, such as an HVAC system, can flow into the first end 130 of the funnel 127. The water drainage can then flow down the funnel 127 and out the second end 133. The fins 139 can guide the water drainage into the drainage opening 142. Particularly, the fins 129 can prevent the water drainage from splashing around the interior of the outlet box 103 and channel the flow into the drainage opening 142. In some embodiments, the drainage opening 142 and the second end of the funnel 127 can be separated by a distance of one inch, referenced in FIG. 2 by L1. Specifically, L1 can represent the distance between a top position of the interior opening of the funnel 127 and the drainage opening 142.

Figure 3A:
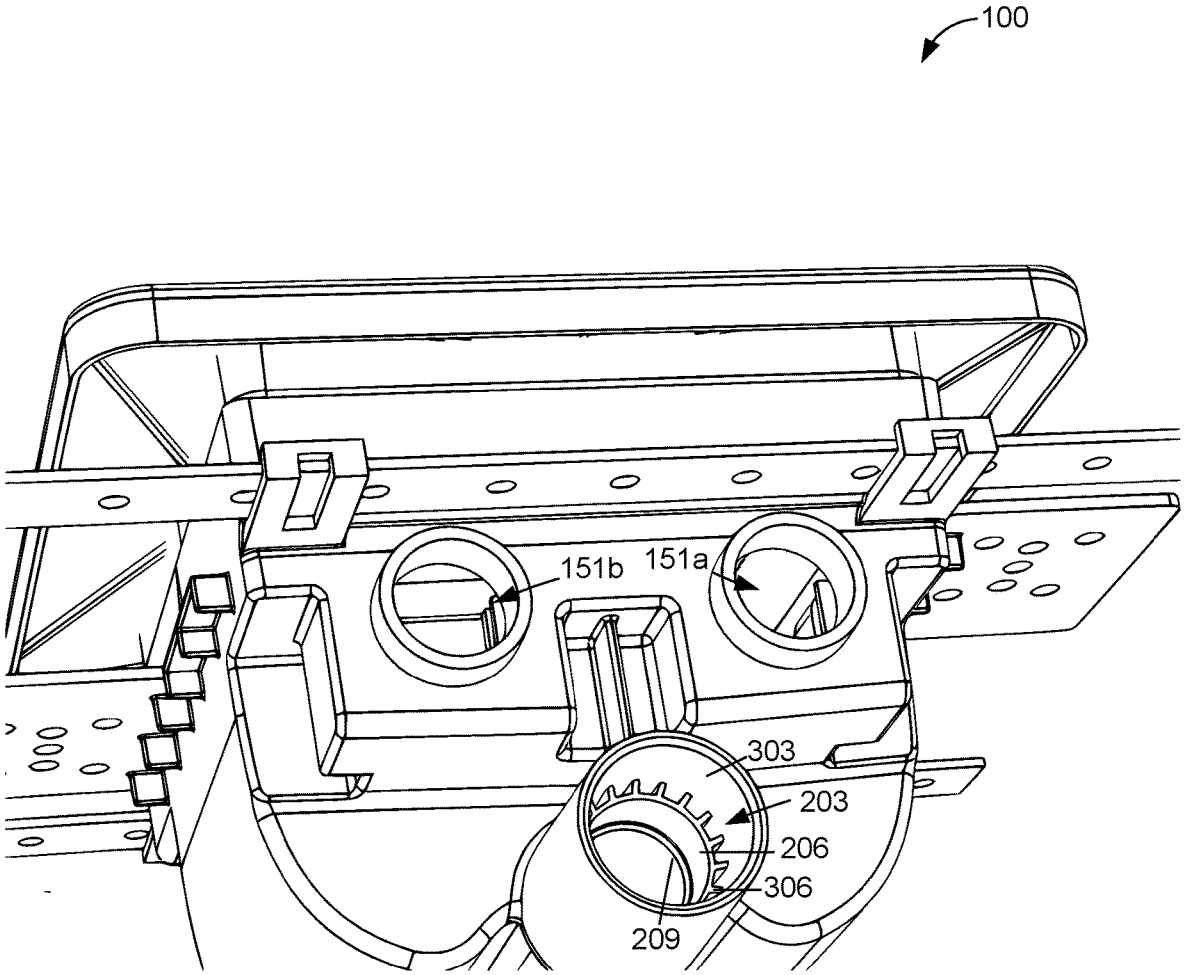
FIGS. 3A and 3B illustrate a top view and a bottom view of the outlet box in FIG. 1A, according to one embodiment described herein.

Turning to FIG. 3A, shown is a top view of the outlet box 103 in FIG. 1C. Particularly, FIG. 3A provides a top view of the glue trap 203 and its inner ring 206. The inner ring 206 attaches to an inner surface 303 of the funnel 127 by way of multiple radial members 306. The inner surface 303 of the funnel 127, the radial members 306, and the inner ring 206 form multiple recessed pockets for capturing excess liquid adhesive for the glue trap 203 in the illustrated embodiment of FIG. 3A.

Figure 3B:
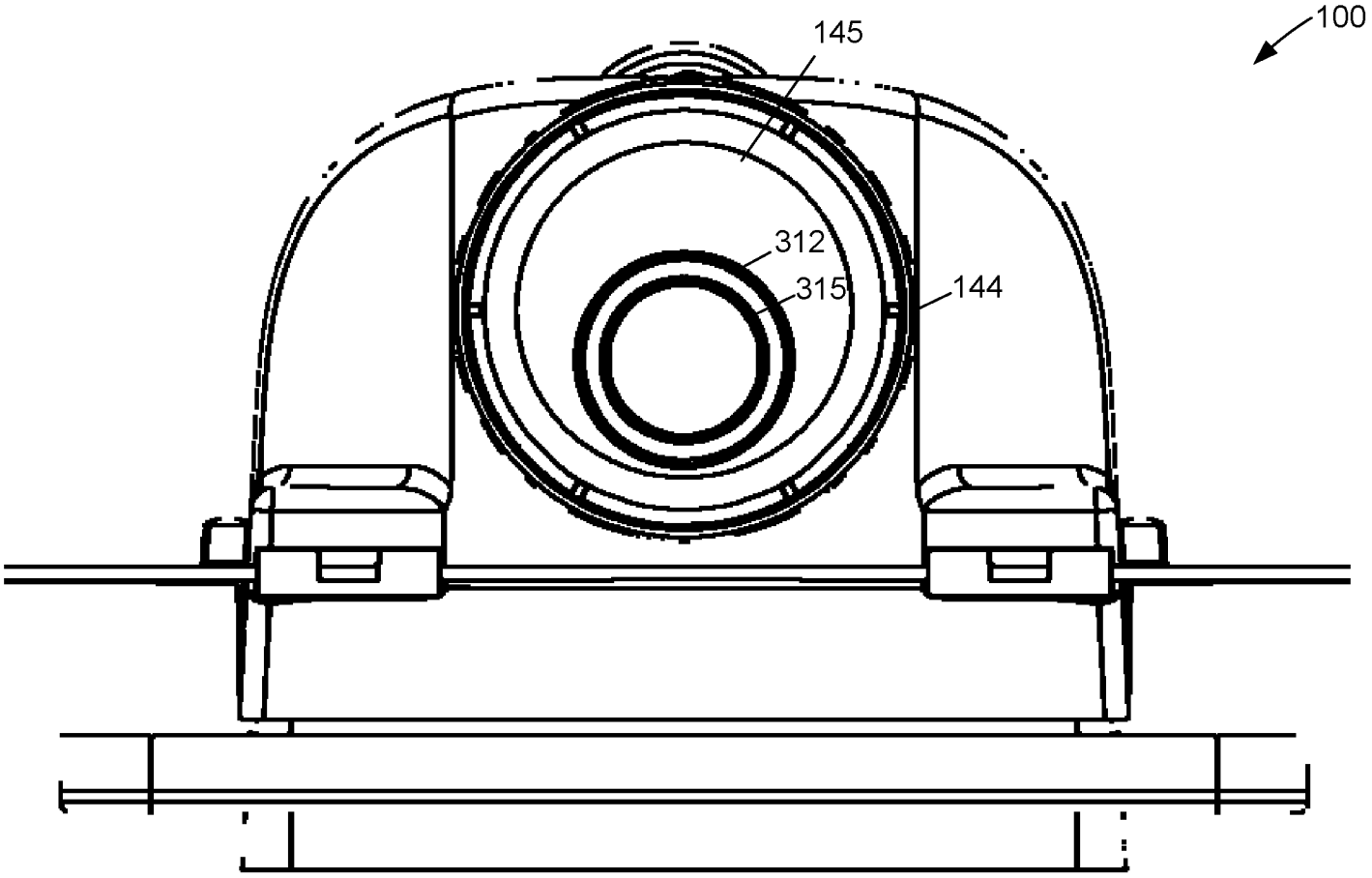

Turning to FIG. 3B, shown is a bottom view of the outlet box 103 in FIG. 1C. Specifically, FIG. 3B illustrates multiple removable components from the bottom side of the outlet box 103. The second removable cover 145 comprises a first valve knockout 312 and a second valve knockout 315. The first valve knockout 312 and the second valve knockout 315 can be removed in order to provide an opening for a valve to be inserted. Thus, in some embodiments, instead of removing the second removable cover 145, a third valve can be inserted through an opening created by removing either the first valve knockout 312 or the second valve knockout 315. The first valve knockout 312 has a larger diameter than the second valve knockout 315. Additionally, the second valve knockout 315 is positioned within the first valve knockout. In some embodiments, the first valve knockout 312 and the second valve knockout 315 are concentric circles with respect to each other.

Figure 4:
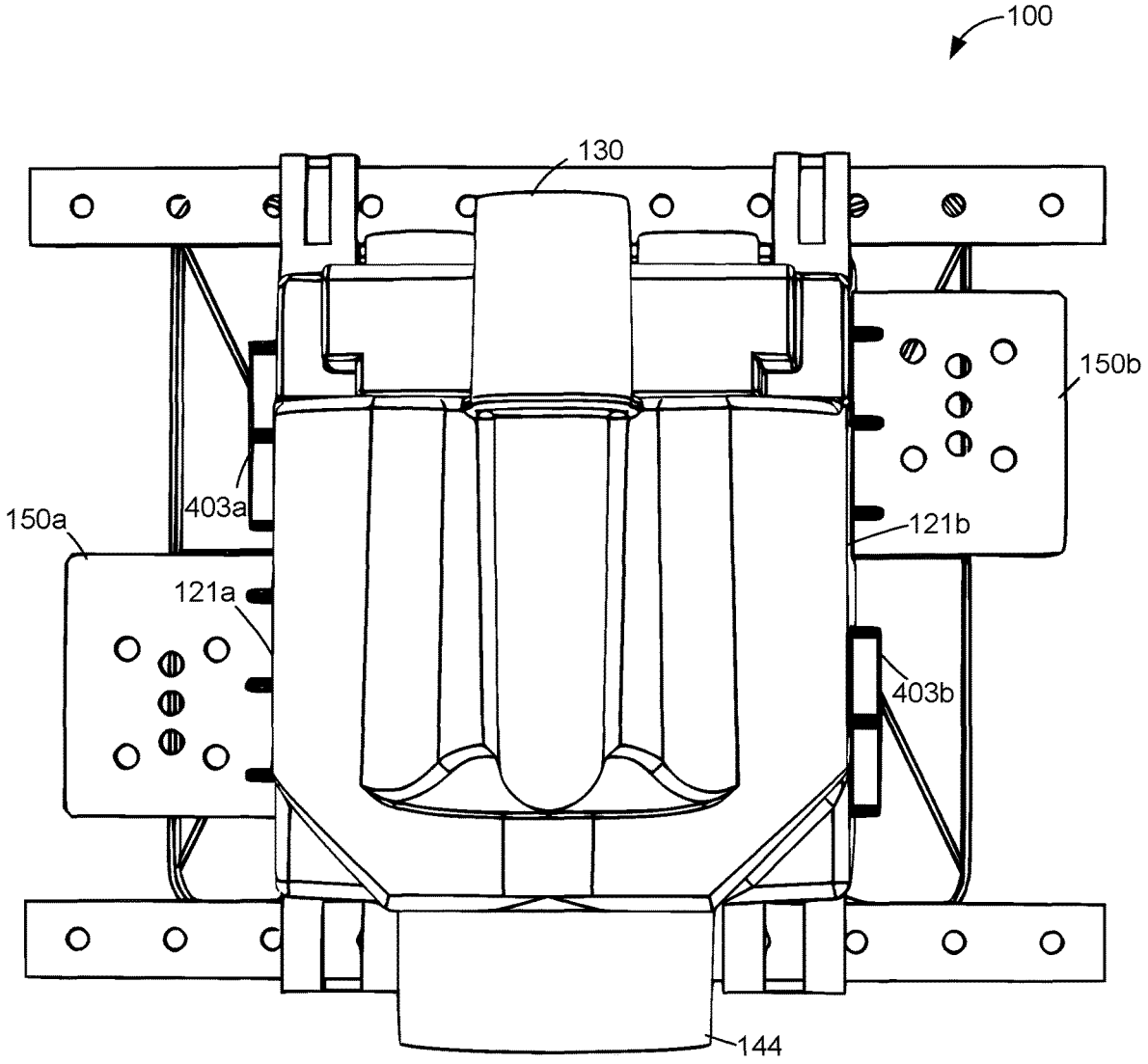
FIG. 4 illustrates a back view of the outlet box in FIG. 1A, according to one embodiment described herein.

Moving to FIG. 4, shown is a back view of the outlet box assembly 100 in FIG. 1C. FIG. 4 illustrates the outlet box 103 comprises the first side wall 121*a* and the second side wall 121*b*. As illustrated in the FIG. 4, the first mounting tab 150*a* extends from the first side wall 121*a* and the second mounting tab 150*b* extends from the second side wall 121*b*. Also, FIG. 4 illustrates a first mounting stop 403*a* extending from the first side wall 121*a* and a second mounting stop 403*b* (collectively "mounting stops 403") extending from the second side wall 121*b*. The mounting stops 403 can serve to properly position outlet box 103 on a wall stud.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A plumbing outlet box configured for mounting within a wall, comprising:

a housing including a top wall, a bottom wall, a back wall, a first side wall, a second side wall, and an opening providing access to the housing;

the bottom wall comprises two water supply inlet openings; and a funnel that forms a portion of the back wall, the funnel extending from the bottom wall, the funnel comprising a first end and a second end, the first end comprising a first opening outside of the housing and the second end comprising a removable cover for access to a second opening inside of the housing, wherein the top wall comprises a drainage opening, the second end of the funnel being proximal to the drainage opening.

2. The plumbing outlet box of claim 1, wherein the second end of the funnel comprises at least one fin that extends from the second end of the funnel toward to the drainage opening and the at least one fin extends from the back wall.

3. The plumbing outlet box of claim 1, wherein the second end of the funnel comprises a recessed area along an outer surface of the funnel.

4. The plumbing outlet box of claim 1, wherein at least one of the first side wall or the second side wall further comprises a mounting tab with a plurality of fastener openings.

5. The plumbing outlet box of claim 1, wherein the first side wall comprises a first mounting tab and the second side wall further comprises a second mounting tab.

6. The plumbing outlet box of claim 1, wherein at least one of the top wall or the bottom wall comprises a mounting head that includes a slot opening for receiving a mounting bracket.

7. The plumbing outlet box of claim 1, wherein the first end of the funnel comprises a concentric circular surface within an inner cavity of the funnel, the concentric circular surface attached to a plurality of radial members extending from an inner surface of the funnel.

8. An apparatus, comprising:

a housing including at least a first wall, a second wall, a third wall, and an opening providing access to the housing, the first wall being attached to the second wall and the third wall; and a funnel that forms a portion of the first wall, the funnel extending from the third wall, the funnel comprising a first end and a second end, the first end comprising a first opening outside of the housing and the second end comprising a second opening inside of the housing, wherein the second wall comprises a drainage opening, the second end of the funnel being proximal to the drainage opening, the second end of the funnel comprises at least one fin that extends from the second end of the funnel toward to the drainage opening, and the at least one fin extends from the first wall.

9. The apparatus of claim 8, wherein the second end of the funnel comprises a removable cover that covers the second opening of the funnel.

10. The apparatus of claim 8, wherein the second end of the funnel is about one inch from the drainage opening.

11. The apparatus of claim 8, further comprising a removable cover that covers the drainage opening.

12. The apparatus of claim 8, wherein the second end of the funnel comprises a recessed area along an outer surface of the funnel.

13. The apparatus of claim 8, wherein the at least one fin comprises a first fin, the second end of the funnel comprises the first fin and a second fin that extend from the second end of the funnel toward to the drainage opening along the first wall.

14. The apparatus of claim 8, wherein the first end of the funnel comprises a concentric circular surface within an inner cavity of the funnel, the concentric circular surface attached to a plurality of radial members extending from an inner surface of the funnel.

15. The apparatus of claim 14, wherein the concentric circular surface comprises an annular inward surface.

16. The apparatus of claim 8, wherein the second opening of the funnel comprises a sloped opening, wherein the at least one fin comprises a first fin and a second fin that extend from a first side and a second side of the sloped opening to the first wall.

17. The apparatus of claim 8, wherein a distance between the drainage opening and the second end of the funnel is one inch.

18. The apparatus of claim 8, wherein the third wall comprises an elevated surface, the funnel extends from the elevated surface.

19. An apparatus, comprising:

a housing including at least a first wall, a second wall, a third wall, and an opening providing access to the housing, the first wall being attached to the second wall and the third wall; and a funnel that forms a portion of the first wall, the funnel extending from the third wall, the funnel comprising a first end and a second end, the first end comprising a first opening outside of the housing and the second end comprising a second opening inside of the housing, wherein the second wall comprises a drainage opening, the second end of the funnel being proximal to the drainage opening, the second end of the funnel comprises a first fin and a second fin that extend from the second end of the funnel toward to the drainage opening along the first wall.

* * * * *